United States Patent [19]

Garavuso et al.

[11] Patent Number: 4,640,504

[45] Date of Patent: Feb. 3, 1987

[54] PADDLE WHEEL FEEDER

[75] Inventors: Gerald M. Garavuso, Macedon, N.Y.; Shwu-Jian Liang, Spring Valley, Ohio; Raghulinga R. Thettu, Webster, N.Y.

[73] Assignee: Xerox Corporation, Stamford, Conn.

[21] Appl. No.: 627,269

[22] Filed: Jul. 2, 1984

[51] Int. Cl.[4] ..... B65H 3/32

[52] U.S. Cl. ..... 271/113; 271/120; 271/264

[58] Field of Search ..... 271/120, 119, 113, 37, 271/109, 264, 275, 314; 221/259, 260, 221; 414/123, 129; 198/479.1

[56] References Cited

U.S. PATENT DOCUMENTS

| | | | |
|---|---|---|---|
| 3,630,516 | 12/1971 | Hong | 271/36 |
| 3,649,003 | 3/1972 | Muller et al. | 271/120 |
| 4,359,219 | 11/1982 | Garavuso | 271/251 |
| 4,372,549 | 2/1983 | Stiernspetz | 271/23 |
| 4,381,860 | 5/1983 | Silverberg | 271/120 |
| 4,515,357 | 5/1985 | Hamlin | 271/120 |

FOREIGN PATENT DOCUMENTS 0108464 2/1900 Fed. Rep. of Germany ..... 271/120

OTHER PUBLICATIONS

IBM Technical Disclosure, vol. 19, No. 10—Mar. 1977—Hunt, pp. 3628 and 3629 and vol. 20, No. 8—Jan. 1978, p. 2923.

IBM Technical Disclosure—vol. 22, No. 8B—Jan. 1980—Mathews, pp. 3486 and 3487.

IBM Technical Disclosure, vol. 24, No. 1A—Jun. 1981—Meyer et al., pp. 381 and 382.

*Primary Examiner*—Douglas C. Butler

*Attorney, Agent, or Firm*—William A. Henry, II

[57] ABSTRACT

An apparatus for feeding individual substrates from the top of a stack of substrates upon demand includes a paddle wheel having paddles that are semi-cylindrical. The paddles buckle upon contact with the substrates rather than bending and thereby providing reduced normal force sensitivity to paddle deflection and reduced pressure since the force of buckling is a function of the paddle cross-section rather than paddle length for all areas of the paddles except near the paddle wheel hub. The semi-circular blades reduce misfeeding and multifeeding while having an extended wear life.

22 Claims, 11 Drawing Figures

PADDLE WHEEL FEEDER

BACKGROUND OF THE INVENTION

This invention relates generally to an electrophotographic printing machine, and more particularly concerns an improved paddle wheel substrate feeding system for feeding substrates, which term is used herein to include sheets of any type, from a stack of sheets along a predetermined path.

Many of the prior sheet feeding mechanisms occasionally malfunction, feeding more than one sheet at a time or failing to feed on demand. Consistent feeding is often difficult to achieve with different stack heights. Complex elevator devices are often employed with some success to maintain the top of stack of sheets at a uniform height.

Presently, many paper handling applications in copiers use elastomeric paddle wheels. Among these are feeders and restack registration where paddle blade deflections vary over several millimeters as sheets are removed or added to the system. In a feeder application, this means that variations in stack height due to stack height sensor differentials and elevator overrun will not cause unacceptable variations in normal force. As a result there is a need for low blade normal force sensitivity to deflection or penetration against the sheet being fed to enhance individual feeding of sheets. In addition, since paddle wheels are elastomeric friction devices, increasing friction and reducing the wear rate of paddle wheels are achievable in many cases by reducing paddle blade contact pressure.

SUMMARY OF THE INVENTION

Accordingly, in accordance with this invention, a paddle wheel feeder apparatus is disclosed that includes a paddle wheel that sweeps the top of a stack of sheets to remove a single sheet from the stack and forward it for further processing. The paddle wheel comprises a rotatable hub to which a plurality of radially extending flexible elastomeric blades or paddles are either fixed by conventional means or molded thereto. The blades are semi-circular in shape and as the hub rotates, the blades buckle upon contact with the stack of sheets creating a larger contact footprint with lower contact pressure for the same normal force than conventional paddle wheel blades thereby allowing increased friction and a reduced wear rate. Also, the buckling of the blades provides vibration damping with a resultant reduction in second sheet creep and noise production.

BRIEF DESCRIPTION OF THE DRAWINGS

The foregoing and other features of the instant invention will be more apparent from a further reading of the specification and claims and from the drawings in which:

While the present invention will be described hereinafter in connection with a preferred embodiment, it will be understood that it not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
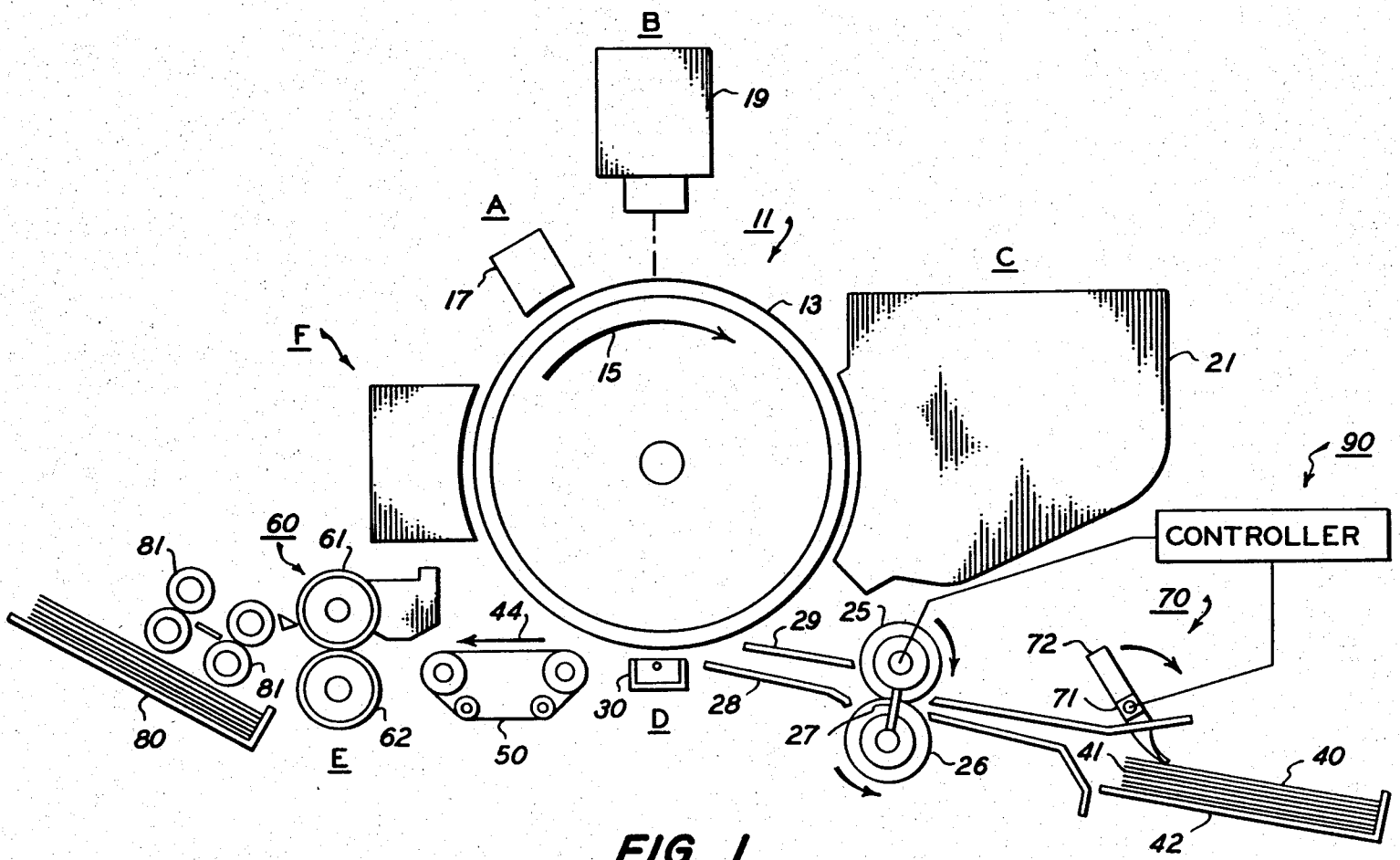
FIG. 1 is a schematic elevational view of an electrophotographic printing machine incorporating the feeder of the instant invention.

For a general understanding of an electrophotographic printing machine in which the features of the present invention may be incorporated, reference is made to FIG. 1, which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art will appreciate that it may be employed for feeding successive original documents.

Since the practice of electrophotographic printing is well known in the art, the various processing stations for producing a copy of an original document are represented in FIG. 1 schematically. Each process station will be briefly described hereinafter.

As in all electrophotographic printing machines of the type illustrated, a drum 11 having a photoconductive surface 13 entrained about and secured to the exterior circumferential surface of a conductive substrate is rotated in the direction of arrow 15 through the various processing stations. The photoconductive surface 13 may be made from selenium. A suitable conductive substrate is made from aluminum.

Initially, drum 11 rotates a portion of photoconductive surface 13 through charging station A. Charging station A employs a conventional corona generating device, indicated generally by the reference numeral 17, to charge photoconductive surface 13 to a relatively high substantially uniform potential.

Thereafter drum 11 rotates the charged portion of photocnoductive surface 13 to exposure station B. Exposure station B includes an exposure mechanism, indicated generally by the reference numeral 19, having a stationary, transparent platen, such as a glass plate or the like for supporting an original document thereon.

Lamps illuminate the original document. Scanning of the original document is achieved by oscillating a mirror in a timed relationship with the movement of drum 11 or by translating the lamps and lens across the original document so as to create incremental light images which are projected through an apertured slit onto the charged portion of photoconductive surface 13. Irradiation of the charged portion of photoconductive surface 13 records an electrostatic latent image corresponding to the information areas contained within the original document.

Drum 11 rotates the electrostatic latent image recorded on photoconductive surface 13 to development station C. Development station C includes a developer unit, indicated generally by the reference numeral 21, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 21 is preferably a magnetic brush development system. A system of this type moves the developer mix through a directional flux field to form a brush thereof. The electrostatic latent image recorded on photoconductive surface 13 is developed by bringing the brush of developer mix into contact therewith. In this manner, the toner particles are attracted electrostatically from the carrier granules to the latent image forming at toner powder image on photoconductive surface 13.

With continued reference to FIG. 1, a copy sheet is advanced by sheet feeding apparatus 70 to transfer station D. Sheet feed apparatus 70 advances successive copy sheets to forwarding registration rollers 25 and 26. Forwarding registration roller 25 is driven conventionally by a motor (not shown) in the direction of photoreceptor 13 and thereby also rotating idler roller 26 which is in contact therewith. In operation, feed device 70 operates to advance the uppermost substrate or sheet from stack 40 into registration rollers 25 and 26 and against registration fingers 27. Fingers 27 are actuated by conventional means in timed relation to an image on drum 11 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by fingers 27, it is advanced through a chute formed by guides 29 and 28 to transfer station D.

Continuing now with the various processing stations, transfer station D includes a corona generating device 30 which applies a spray of ions to the back side of the copy sheet. This attracts the toner powder image from photoconductive surface 13 to the copy sheet.

After transfer of the toner powder image to the copy sheet, the sheet is advanced by endless belt conveyor 50, in the direction of arrow 44, to fusing station E.

Fusing station E includes a fuser assembly indicated generally by the reference numeral 60. Fuser assembly 60 includes a fuser roll 61 and a backup roll 62 defining a nip therebetween through which the copy sheet passes. After the fusing process is completed, the copy sheet is advanced by conventional rollers 81 to catch tray 80.

Invariably, after the copy sheet is separated from photoconductive surface 13, some residual toner particles remain adhering thereto. Those toner particles are removed from photoconductive surface 13 at cleaning station F. Cleaning station F includes a corona generating device (not shown) adapted to neutralize the remaining electrostatic charge on photoconductive surface 13 and that of the residual toner particles. The neturalized toner particles are then cleaned from photoconductive surface 13 by a rotatably mounted fibrous brush (not shown) in contact therewith. Subsequent to cleaning, a discharge lamp (not shown) floods photoconductive surface 13 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the top feeder system in greater detail.

Referring now more specifically to FIG. 1, the detailed structure and operation of the present invention will be described. Sheets 41 are shown stacked in tray 42 that has a conventional lift mechanism therein, such as springs, or an elevator that maintains the stack in correct striking distance to the feed members. A conventional controller 90 operates as required paddle wheel feeder mechanism 70 which through inertial separation and feeding drives single sheets off stack 40 to registration fingers 27 to await further transport in synchronism with images on photoreceptor 13. The paddle wheel feeder mechanism comprises a hub 71 with paddles or blades 72 attached thereto. The advantage of paddle wheels over said rolls is their relative insensitivity of normal force to penetration and as a result variations in stack height due to stack height sensor differential and elevator overrun will not cause unacceptable variations in normal force. Paddle wheel mechanism 70 capitalizes upon this insensitivity because paddle wheel blades 72 are semi-cylindrical in shape and, therefore, buckle upon contact with the stack of sheets rather than bending and since the force of buckling is a function of blade cross-section as opposed to blade length, the normal force is far less sensitive to deflection in every region of the blades except near hub 71 where stiffening takes place.

Figure 2:
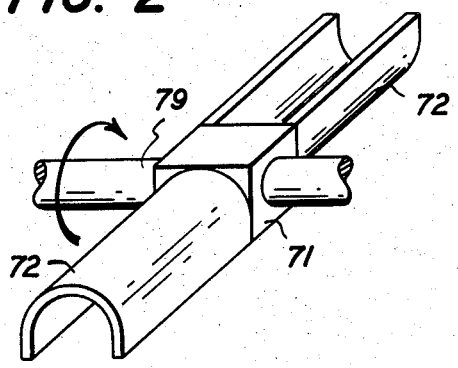
FIG. 2 is an enlarged partial isometric view of the paddle wheel used in the instant invention.

The semi-circular blades 72 of paddle wheel mechanism 70, shown in detail in FIG. 2, also presents a larger contact footprint to the top of sheet stack 40 with lower contact pressure for the same normal force thereby increasing friction and reducing wear. In addition, the curved design of the paddle wheel blades reduces blade slap and thereby reducing vibration of the blades which is a major cause of second sheet creep and noise production.

Figure 3:
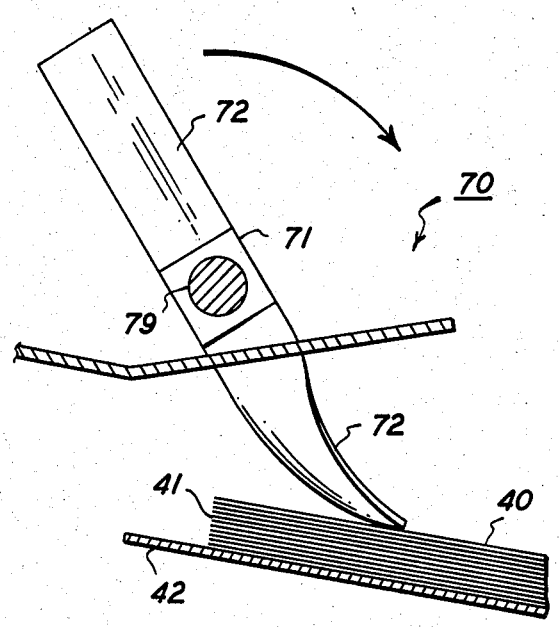
FIG. 3 is an enlarged partial side view of the paddle wheel of the instant invention.
Figure 4:
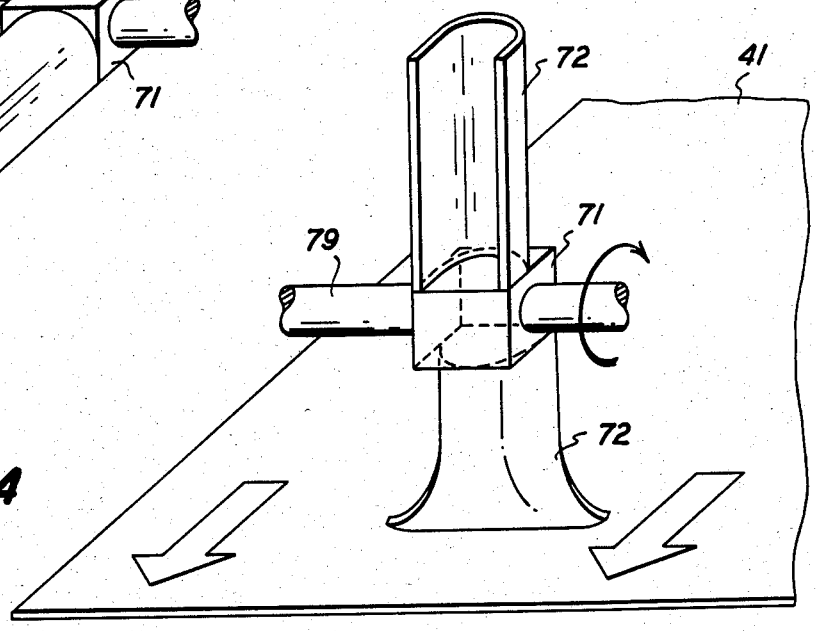
FIG. 4 is a partial schematic of the present invention showing the buckling of a blade against a sheet.

Rotation of paddle wheel hub 71 as shown in FIG. 3 causes blades 72 to strike sheet stack 40 with enough force to buckle blades 72 against the top sheet in the stack. The buckling action causes the semi-circular blades to present an increasing area of blade surface against the sheet as the blades are continued in rotation after initially contacting the stack. This increase in blade area against the top sheet in the stack, as shown more specifically in FIG. 4, presents an increasingly wide frictional surface to the top of the sheet stack without an expected concomitant increse in normal force. As a result, increased reliability against misfeeds and multifeeds is obtained as well as blade wear longevity since the buckling allows the use of less normal pressure than would be required for feeding with straight blades.

Figure 5:
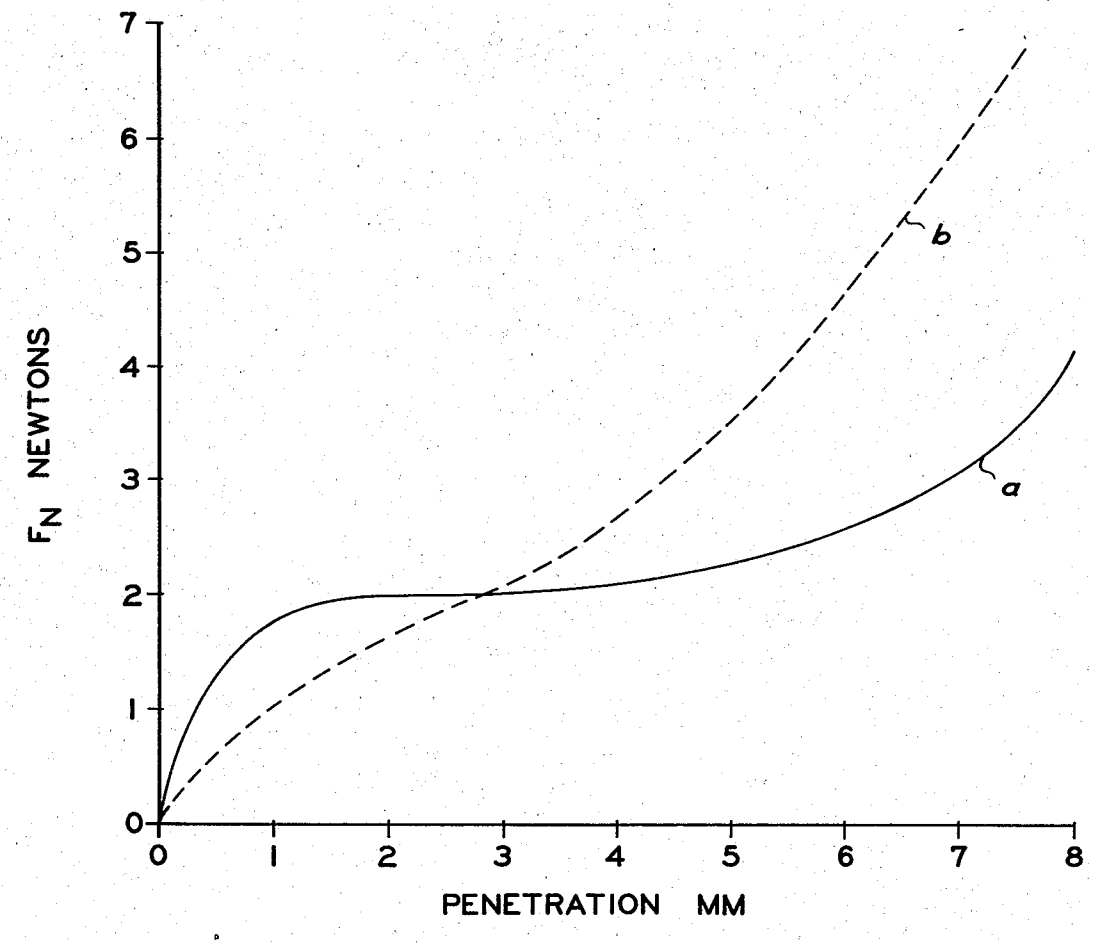
FIG. 5 is a graph depicting the differences between normal force and penetration of straight and curved paddle wheel blades of a paddle wheel feeder.

The normal force sensitivity advantage of curved paddle wheel blades in accordance with the instant invention over straight blades is shown in FIG. 5. In FIG. 5, the amount of blade penetration or deflection is plotted versus normal force and as can be seen, a greater amount of blade penetration is accomplished with curved blades, shown by solid line a, with less normal force variation than is obtainable with straight blades as indicated on the chart by dotted line b. For example, with semi-circular blades 6 mm of blade penetration was obtained with a normal force of 0.25 newtons. While only 4 mm of penetration with straight blades was obtained with approximately the same 0.25 newtons normal force. The straight blades were 10 mm wide, 3.4 mm thick and made from GE RTV 700 $\beta 1$ elastomeric material. The curved blades were 17.5 mm long, 1.5 mm thick and made from Dow Q39595 elastomeric material. Both blades were rotated at 500 RPM onto 20 lb. paper. Both the GE and Dow materials are silicone based and exhibit similar material properties.

Figure 6:
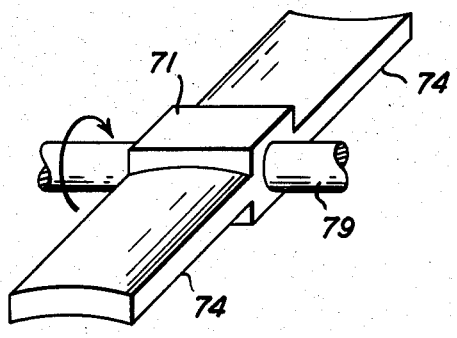
FIGS. 6 and 7 show alternative embodiments of the paddle wheel of the present invention that includes concave profiled blades in FIG. 6 and concave profiled blades with golf club shaped tips in FIG. 7.
Figure 7:
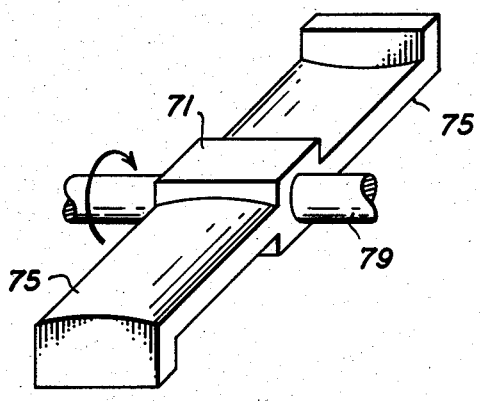

An alternative to semi-circular paddle wheel blades is shown in the embodiments of FIGS. 6 and 7 where blades 74 and 75 are attached to hub 71 which is mounted on shaft 79 for rotation in the direction of the arrow under the control of controller 90. Paddle wheel blades 74 and 75 are concave in shape or profile and as a result provide constant force $F_n$ to the top of a sheet stack. This constant force decreases the performance sensitivity of paddle wheels as related to blade penetration during sheet feeding and also decreases wear of the blades. The gold club tip profile of blades 75 further increases the wear life of blades. For example, it was found that to reach the same wear contour, 20 mm golf club blades have to run twice as many copies when compared with 12 mm straight blades.

Figure 8:
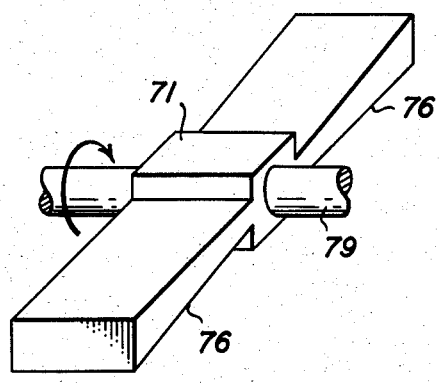
FIGS. 8 and 9 show further alternative embodiments of the paddle wheel of the present invention that includes blades with tapered thicknesses in FIG. 8 and the same blades with gold club shaped tips in FIG. 9.
Figure 10:
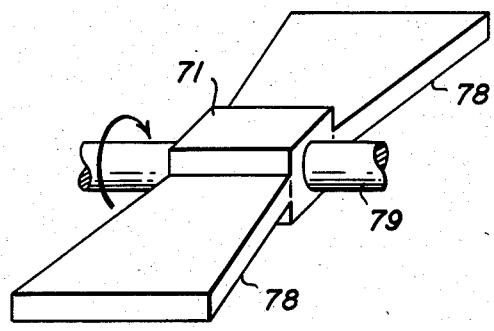
FIGS. 10 and 11 show yet further alternative embodiments of the paddle wheel of the present invention that includes blades that are tapered in width in FIG. 10 and the same blades with gold club shaped tips in FIG. 11.
Figure 9:
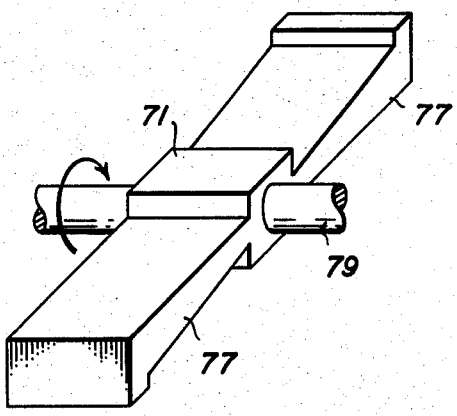
Figure 11:
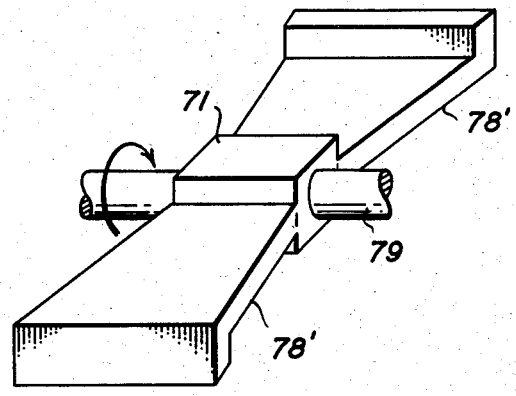

Further, the blades of the paddle wheel contemplated by this invention could take a tapered thickness shape or a tapered width shape and sheet feeding results would be vastly improved over what is obtainable with paddle wheels having straight blades. For example, in FIGS. 8 and 9 paddle wheels are shown with blades 76 and 77 having tapered thicknesses from hubs 71 to their tips with blades 77 including gold club shaped tips. FIG. 10 and 11 show paddle wheel blades 78 and 78' also having golf club shaped tips for increased longevity of wear.

It should now be apparent that a paddle wheel feeder has been disclosed with blades that are curved about the axes of the paddle and thereby significantly improves the performance of the paddle wheel feeder. The curvature of the blade gives a force-displacement curve with a large region of small slope. This relative insensitivity of the paddle force to the penetration of the paddles into a sheet stack is of utmost importance in preventing multifeeds, misfeeds and sheet damage. In addition, the curvature provides a larger stack contact area and reduces vibration and noise.

Other variations and modifications of the apparatus of this invention will occur to those skilled in the art upon reading of this disclosure. These are intended to be included within the scope of this invention, as defined in the appended claims.

What is claimed is:

1. A paddle wheel feeder adapted to feed sheets individually from a stack of sheets including a paddle wheel having a plurality of individual blades adapted to strike the stack one at a time to inertially separate the top sheet in the stack from the rest of the stack, characterized in that said each of said plurality of blades are semi-circular in shape with respect to an axis running orthogonal to the axis of rotation of said paddle wheel.

2. The feeder of claim 1, wherein said plurality of blades buckle individually as they strike the top of the stack.

3. The feeder of claim 2, wherein said plurality of blades present a footprint at the tip of each blade that increases in a direction transverse to the lengthwise dimension of each blade as each blade is rotated against the top of the stack.

4. The feeder of claim 1, wherein the contact area of said blades buckles as the blades contact the top sheet in the stack so as to present an increasingly wider frictional surface to the top sheet in the stack without an increase in normal force.

5. The feeder of claim 1, wherein said plurality of blades are elastomeric.

6. The feeder of claim 1, wherein said semi-circular shape of said plurality of blades reduces blade slap against the sheet stack and thereby provides vibration damping with a resultant reduction in second sheet creep and noise production 7. A paddle wheel feeder adapted to feed sheets individually from a stack of sheets including at least one paddle wheel having a hub and a plurality of individual blades extending from the hub and adapted to strike the stack to inertially separate the top sheet in the stack from the rest of the stack, characterized in that at least a portion of each of said plurality of blades in their unstressed condition is of a uniformly hollow curved cross-section theroughtout the length of said blades with the axis of curvature of the blades extending radially of the wheel.

8. The feeder of claim 7, wherein each of said plurality of blades are concave in shape.

9. The feeder of claim 7, wherein said paddle wheel blades in their unstressed condition have an open hollow U-shaped form about their axis of curvature.

10. The feeder of claim 8, wherein said plurality of blades in an unstressed condition have orthogonally extending tip portions.

11. A paddle wheel feeder adapted to feed sheets individually from a stack of sheets including a paddle wheel having a plurality of individual blades adapted to strike the stack to inertially separate the top sheet in the stack from the rest of the stack, characterized in that each of said blades increase in thickness from the axis of said paddle wheel to the ends of said blades.

12. The feeder of claim 11, wherein said plurlaity of blades have orthogonally extending tips.

13. A paddle wheel feeder adapted to feed sheets individually from a stack of sheets including a paddle wheel having a plurality of blades adapted to strike the stack one at a time to inertially separate the top sheet in the stack from the rest of the stack, characterized in that said blades increase in width from the axis of said paddle wheel to their tips.

14. The feeder of claim 13, wherein said plurality of blades have orthogonally extending tips.

15. A paddle wheel feeder adapted to feed sheets individually from a stack of sheets including at least one paddle wheel having a plurality of blades adapted to inertially separate the top sheet in the stack from the rest of the stack, said blades being elongated and in their unstressed condition said blades have an open, hollow semi-cylindrical form about their elongated axis which is orthogonal to the axis of rotation of the paddle wheel.

16. The feeder of claim 15, wherein a tip of said elongated blades is adapted to upen upwardly to provide a wider footprint in response to the blades contacting the sheet to be fed.

17. The feeder of claim 15, wherein said elongated blades are relatively thin walled and generally U-shaped.

18. The feeder of claim 15, wherein said elongated blades on the same axis are adapted to open in opposite directions.

19. The feeder of claim 17, wherein said generally U-shaped elongated blades are positioned and adapted such that the bottom of said generally U-shaped blades contacts the stack of sheets first.

20. A paddle wheel feeder adapted to feed sheets individually from a stack of sheets including at least one paddle wheel having a hub and a plurality of individual blades extending outwardly radially from the hub, said plurality of blades being adapted to strike the top sheet in the stack one at a time to inertially separate the top sheet in the stack from the rest of the stack, the improvement wherein each of said plurality of blades is concave with respect to a vertical plane through said hub.

21. The paddle wheel feeder of claim 20, wherein said at least one paddle wheel comprises at least two blades on opposite sides of said hub, said blades being concave in opposite directions about a single longitudinal axis.

22. The paddle wheel feeder of claim 20, wherein said plurality of blades and said hub comprise a single unitary elastomeric member.

* * * * *